US009443498B2

(12) United States Patent
Clark

(10) Patent No.: US 9,443,498 B2
(45) Date of Patent: Sep. 13, 2016

(54) PUPPETMASTER HANDS-FREE CONTROLLED MUSIC SYSTEM

(71) Applicant: Kevin Clark, Westport, CT (US)

(72) Inventor: Kevin Clark, Westport, CT (US)

(73) Assignee: Golden Wish LLC, Allston, MA (US)

( * ) Notice: Subject to any disclaimer, the term of this patent is extended or adjusted under 35 U.S.C. 154(b) by 12 days.

(21) Appl. No.: 14/246,032

(22) Filed: Apr. 4, 2014

(65) Prior Publication Data

US 2014/0298975 A1 Oct. 9, 2014

Related U.S. Application Data

(60) Provisional application No. 61/808,280, filed on Apr. 4, 2013.

(51) Int. Cl.

| | |
|---|---|
| ***G10H 1/32*** | (2006.01) |
| ***G10H 3/00*** | (2006.01) |
| ***G10H 1/00*** | (2006.01) |

(52) U.S. Cl.

CPC ..... *G10H 1/0025* (2013.01); *G10H 2220/201* (2013.01); *G10H 2220/455* (2013.01); *G10H 2240/131* (2013.01)

(58) Field of Classification Search

CPC ..... G10H 1/0025; G10H 2220/201; G10H 2220/455; G10H 2240/131

USPC ..... 84/743

See application file for complete search history.

(56) References Cited

U.S. PATENT DOCUMENTS

| | | | | |
|---|---|---|---|---|
| 6,245,982 | B1 * | 6/2001 | Suzuki | G09B 15/002 84/477 R |
| 6,646,644 | B1 * | 11/2003 | Suzuki et al. | 345/474 |
| 7,402,743 | B2 * | 7/2008 | Clark et al. | 84/615 |
| 7,989,689 | B2 * | 8/2011 | Sitrick | G09B 15/023 84/477 R |
| 8,017,851 | B2 * | 9/2011 | Horovitz et al. | 84/611 |
| 8,080,723 | B2 * | 12/2011 | Yagi | 84/611 |
| 8,753,165 | B2 * | 6/2014 | Weston | A63H 3/00 340/10.1 |
| 8,754,317 | B2 * | 6/2014 | Sitrick et al. | 84/723 |
| 2007/0000374 | A1 * | 1/2007 | Clark | G10H 1/0008 84/724 |
| 2008/0012866 | A1 * | 1/2008 | Forbes | G06T 13/40 345/473 |
| 2010/0093252 | A1 * | 4/2010 | Hu | A63H 3/14 446/327 |
| 2010/0253700 | A1 * | 10/2010 | Bergeron | G03B 35/00 345/633 |
| 2012/0144979 | A1 * | 6/2012 | Tansley | G10H 1/0066 84/645 |
| 2014/0074479 | A1 * | 3/2014 | Kassam | G10H 1/0025 704/270 |
| 2015/0030305 | A1 * | 1/2015 | Moon | G06T 13/40 386/201 |

OTHER PUBLICATIONS

"Arm Tracks: All Body-Controlled Ableton Live, with Kinect, Brings Shirtless Musical Innovation," createdigitalmusic.com, Peter Kim, Jul. 12, 2012.*

* cited by examiner

*Primary Examiner* — Jeffrey Donels

(74) *Attorney, Agent, or Firm* — Daniel N. Smith

(57) ABSTRACT

A system for using body motion capture for musical performances. A motion detection camera captures a series of body movements which are assigned to begin one of more songs, to activate musical filters, and to active sound effects. Once the movements are captured and assignment, the user begins the performance.

9 Claims, 3 Drawing Sheets

PUPPETMASTER HANDS-FREE CONTROLLED MUSIC SYSTEM

CROSS REFERENCE TO RELATED APPLICATION

This application claims the benefit of U.S. Provisional Patent Application No. 61/808,280, filed on Apr. 4, 2013, the contents of which are incorporated herein by reference.

FIELD OF THE INVENTION

The field of the invention relates to a body motion-based music control system. The system allows a user to control the development, pace, and shape of musical phrases using only body movement.

BACKGROUND OF INVENTION

Many music fans often wish to experience a piece of music on a deeper level. In order to accomplish this, a person may learn to play musical pieces. However, this endeavor requires significant resources of money and time. Learning to play a musical piece also allows a person to adapt or modify the piece.

Even if a person has the resources of time and money, he or she may not have the musical talent to re-create or adapt a musical piece.

For electronic music, learning to play a musical piece may not be possible since all the music is made using samples or analogue sounds which would be nearly impossible, or extremely costly, to recreate. Thus, it is very difficult for a person to re-create or adapt a piece of electronic music.

Thus, a system that allows musical fans to re-create and adapt musical performances, especially electronic musical performances, is needed.

In recent years, motion-detection technology has allowed performers to control one or more musical instruments to compose a musical piece. These systems often require multiple computing devices, multiple musical instruments, and multiple operators to properly function.

The system of the subject invention provides an easy to use system for re-creating or adapting a musical piece with very little or no experience in musical instruments or musical composition. The system may be operated by one user and one computing device.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting The subject invention discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects a user, further wherein the depth camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least one song from the first database, assigns the second bodily movement to end performance of the at least one song from the first database, assigns each bodily movement from the third plurality of bodily movements to perform musical filters on the second database, assigns each bodily movement from the fourth plurality of bodily movements to perform musical song elements on the third database, wherein the user performs the first, second, third plurality and fourth plurality of bodily movements to produce a musical performance.

The subject invention also discloses a body-motion based music control performance system, comprising: a computing device comprising executable software; a data storage device; a first database of musical songs on the data storage device; a second database of musical filters on the data storage device; a third database of musical song elements on the data storage device; a motion detection camera, wherein the motion detection camera detects a user, further wherein the motion detection camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least one song from the first database, assigns the second bodily movement to end performance of the at least one song from the first database, assigns each bodily movement from the third plurality of bodily movements to perform musical filters on the second database, assigns each bodily movement from the fourth plurality of bodily movements to perform musical song elements on the third database, wherein the user performs the first, second, third plurality and fourth plurality of bodily movements to produce a musical performance.

The subject invention further discloses a body-motion based music control performance system, comprising: a computing device comprising executable software; a data storage device; wherein the anatomical size and shape of a user is inputted into the computing device; a first database of musical songs on the data storage device; a second database of musical filters on the data storage device; a third database of musical song elements on the data storage device; a motion detection camera, wherein the motion detection camera detects a head, left arm, right arm, torso, left leg, and right leg of the user, further wherein the motion detection camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least one song from the first database, assigns the second bodily movement to end performance of the at least one song from the first database, assigns each bodily movement from the third plurality of bodily movements to perform musical filters on the second database, assigns each bodily movement from the fourth plurality of bodily movements to perform musical song elements on the third database, wherein the user performs the first, second, third plurality and fourth plurality of bodily movements to produce a musical performance.

The subject invention discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects a user, further wherein the depth camera captures a plurality of bodily movements of the users and the plurality of bodily movements are transmitted to a fourth database on the data storage device for storage, further wherein the user uses the executable software to assign a first bodily movement to begin performance of at least one song from the first database, assigns a second bodily movement to end performance of the at least one song from the first database, assigns a first series of bodily movement to perform musical filters on the second database, assigns a second series of bodily movements to perform musical song elements on the third database, wherein the user performs the plurality of bodily movements to produce a musical performance.

The subject invention further discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects two feet, two knees, one torso, two elbows, two shoulders, two hands, and the head of a user, further wherein the depth camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least one song from the first database, assigns the second bodily movement to end performance of the at least one song from the first database, assigns each bodily movement from the third plurality of bodily movements to perform musical filters on the second database, assigns each bodily movement from the fourth plurality of bodily movements to perform musical song elements on the third database, wherein the user performs the first, second, third plurality and fourth plurality of bodily movements to produce a musical performance.

In embodiments of the subject invention, first, second, third plurality and fourth plurality of bodily movements may include the X and Y locations of the user's hands.

In embodiments of the subject invention, the one song from the first database may be a pre-recorded song or portion of a song.

In embodiments of the subject invention, the musical filter from the second database may be adjustments to the pitch, speed, duration, intensity, timbre, or frequency of a musical tone or tones.

In embodiments of the subject invention, the musical filter from the second database may be adjustments to the pitch, rhythm, tempo, timing, speed, duration, intensity, timbre, of the vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

In embodiments of the subject invention, the song element from the third database may be vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

The subject invention discloses a musical performance system, comprising: a computing device comprising executable software; a data storage device; a first database of pre-recorded musical performances on the data storage device; a second database of musical effects on the data storage device; a third database of musical components on the data storage device; a depth camera, wherein the depth camera detects a user, further wherein the depth camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least pre-recorded musical performance from the first database, assigns the second bodily movement to end performance of the at least pre-recorded musical performance from the first database, assigns each bodily movement from the third plurality of bodily movements to perform musical effects on the second database, assigns each bodily movement from the fourth plurality of bodily movements to perform musical components on the third database, wherein the user performs the first, second, third plurality and fourth plurality of bodily movements to produce a musical performance.

The subject invention further discloses a body-motion based music control performance system, comprising: a computing device comprising executable software; a data storage device; a first database of pre-recorded musical performances on the data storage device; a second database of musical effects on the data storage device; a third database of musical components on the data storage device; a motion detection camera, wherein the motion detection camera detects a user, further wherein the motion detection camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least pre-recorded musical performance from the first database, assigns the second bodily movement to end performance of the at least pre-recorded musical performance from the first database, assigns each bodily movement from the third plurality of bodily movements to perform musical effects on the second database, assigns each bodily movement from the fourth plurality of bodily movements to perform musical components on the third database, wherein the user performs the first, second, third plurality and fourth plurality of bodily movements to produce a musical performance.

The subject invention also discloses a body-motion based music control performance system, comprising: a computing device comprising executable software; a data storage device; wherein the anatomical size and shape of a user is inputted into the computing device; a first database of pre-recorded musical performances on the data storage device; a second database of musical effects on the data storage device; a third database of musical components on the data storage device; a motion detection camera, wherein the motion detection camera detects a head, left arm, right arm, torso, left leg, and right leg of the user, further wherein the motion detection camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least pre-recorded musical performance from the first database, assigns the second bodily movement to end performance of the at least pre-recorded musical performance from the first database, assigns each bodily movement from the third plurality of bodily movements to perform musical effects on the second database, assigns each bodily movement from the fourth plurality of bodily movements to perform musical components on the third database, wherein the user performs the first, second, third plurality and fourth plurality of bodily movements to produce a musical performance.

The subject invention further discloses a musical performance system, comprising: a computing device comprising executable software; a data storage device; a first database of pre-recorded musical performances on the data storage device; a second database of musical effects on the data storage device; a third database of musical components on the data storage device; a depth camera, wherein the depth camera detects a user, further wherein the depth camera captures a plurality of bodily movements of the users and the plurality of bodily movements are transmitted to a fourth database on the data storage device for storage, further wherein the user uses the executable software to assign a first bodily movement to begin performance of at least pre-recorded musical performance from the first database, assigns a second bodily movement to end performance of the at least pre-recorded musical performance from the first database, assigns a first series of bodily movement to perform musical effects on the second database, assigns a second series of bodily movements to perform musical components on the third database, wherein the user performs the plurality of bodily movements to produce a musical performance.

The subject invention discloses a musical performance system, comprising: a computing device comprising executable software; a data storage device; a first database of pre-recorded musical performances on the data storage device; a second database of musical effects on the data storage device; a third database of musical components on the data storage device; a depth camera, wherein the depth camera detects two feet, two knees, one torso, two elbows, two shoulders, two hands, and the head of a user, further wherein the depth camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least pre-recorded musical performance from the first database, assigns the second bodily movement to end performance of the at least pre-recorded musical performance from the first database, assigns each bodily movement from the third plurality of bodily movements to perform musical effects on the second database, assigns each bodily movement from the fourth plurality of bodily movements to perform musical components on the third database, wherein the user performs the first, second, third plurality and fourth plurality of bodily movements to produce a musical performance.

In embodiments of the subject invention, first, second, third plurality and fourth plurality of bodily movements may include the X and Y locations of the user's hands.

In embodiments of the subject invention, the pre-recorded musical performance from the first database may be a pre-recorded song or portion of a song.

In embodiments of the subject invention, the musical effect from the second database may be adjustments to the pitch, speed, duration, intensity, timbre, or frequency of a musical tone or tones.

In embodiments of the subject invention, the musical effect from the second database may be adjustments to the pitch, rhythm, tempo, timing, speed, duration, intensity, timbre, of the vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

In embodiments of the subject invention, the component from the third database may be vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

The subject invention further discloses a system for body-motion based music control, comprising: a computing device comprising executable software; a data storage device; a first database of musical sounds on the data storage device; a depth camera, wherein the depth camera detects a user, further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention also discloses a system for body-motion based music control, comprising: a computing device comprising executable software; a data storage device comprising a first database, wherein the anatomical size and shape of a user is inputted into the computing device; a depth camera, wherein the depth camera detects a head, left arm, right arm, torso, left leg, and right leg of the user; further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention further discloses a method for body-motion based music control, comprising: inputting the height, weight, sex, and body type of a user into a computing device that comprises a data storage device and executable software; a depth camera, wherein the depth camera detects a user, further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention discloses a computer-implemented system for using body-motion recognition to produce musical compositions, comprising: a computing device comprising executable software; a data storage device; a first database of musical sounds on the data storage device; a motion detection camera, wherein the motion detection camera detects a human being, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

The subject invention further discloses a computer-implemented system for using body-motion recognition to produce musical compositions, comprising: a computing device comprising executable software; a data storage device; a first database of musical sounds on the data storage device; a motion detection camera, wherein the anatomical size and shape of a user is inputted into the computing device; a depth camera, wherein the depth camera detects a head, left arm, right arm, torso, left leg, and right leg of the user, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

The subject invention discloses a computer-implemented system for using body-motion recognition to produce musical compositions, comprising: inputting the height, weight, sex, and body type of a user into a computing device comprising executable software; a data storage device; a first database of musical sounds on the data storage device; a motion detection camera, wherein the motion detection camera detects a human being, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

The subject invention also discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects a user, further wherein the depth camera captures a first free space gesture of the user, a second free space gesture of the user, a third plurality of free space gestures of the user, a fourth plurality of free space gestures of the user, wherein the first, second, third plurality and fourth plurality of free space gestures of the user are transmitted to a fourth database on the data storage device for storage, further wherein the user uses the executable software to assign the first free space gesture to begin performance of at least one song from the first database, assigns the second free space gesture to end performance of the at least one song from the first database, assigns each free space gesture from the third plurality of free space gestures to perform musical filters on the second database, assigns each free space gesture from the fourth plurality of free space gestures to perform musical song elements on the third database, wherein the user performs the first, second, third plurality and fourth plurality of free space gestures to produce a musical performance.

The subject invention further discloses a body-motion based music control performance system, comprising: a computing device comprising executable software; a data storage device; a first database of musical songs on the data storage device; a second database of musical filters on the data storage device; a third database of musical song elements on the data storage device; a motion detection camera, wherein the motion detection camera detects a user, further wherein the motion detection camera captures a first free space gesture of the user, a second free space gesture of the user, a third plurality of free space gestures of the user, a fourth plurality of free space gestures of the user, wherein the first, second, third plurality and fourth plurality of free space gestures of the user are transmitted to a fourth database on the data storage device for storage, further wherein the user uses the executable software to assign the first free space gesture to begin performance of at least one song from the first database, assigns the second free space gesture to end performance of the at least one song from the first database, assigns each free space gesture from the third plurality of free space gestures to perform musical filters on the second database, assigns each free space gesture from the fourth plurality of free space gestures to perform musical song elements on the third database, wherein the user performs the first, second, third plurality and fourth plurality of free space gestures to produce a musical performance.

The subject invention discloses a body-motion based music control performance system, comprising: a computing device comprising executable software; a data storage device; wherein the anatomical size and shape of a user is inputted into the computing device; a first database of musical songs on the data storage device; a second database of musical filters on the data storage device; a third database of musical song elements on the data storage device; a motion detection camera, wherein the motion detection camera detects a head, left arm, right arm, torso, left leg, and right leg of the user, further wherein the motion detection camera captures a first free space gesture of the user, a second free space gesture of the user, a third plurality of free space gestures of the user, a fourth plurality of free space gestures of the user, wherein the first, second, third plurality and fourth plurality of free space gestures of the user are transmitted to a fourth database on the data storage device for storage, further wherein the user uses the executable software to assign the first free space gesture to begin performance of at least one song from the first database, assigns the second free space gesture to end performance of the at least one song from the first database, assigns each free space gesture from the third plurality of free space gestures to perform musical filters on the second database, assigns each free space gesture from the fourth plurality of free space gestures to perform musical song elements on the third database, wherein the user performs the first, second, third plurality and fourth plurality of free space gestures to produce a musical performance.

The subject invention also discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects a user, further wherein the depth camera captures a plurality of free space gestures of the users and the plurality of free space gestures are transmitted to a fourth database on the data storage device for storage, further wherein the user uses the executable software to assign a first free space gesture to begin performance of at least one song from the first database, assigns a second free space gesture to end performance of the at least one song from the first database, assigns a first series of free space gesture to perform musical filters on the second database, assigns a second series of free space gestures to perform musical song elements on the third database, wherein the user performs the plurality of free space gestures to produce a musical performance.

The subject invention further discloses a musical performance system, comprising: a computing device comprising executable software; a data storage device; a first database of musical songs on the data storage device; a second database of musical filters on the data storage device; a third database of musical song elements on the data storage device; a depth camera, wherein the depth camera detects two feet, two knees, one torso, two elbows, two shoulders, two hands, and the head of a user, further wherein the depth camera captures a first free space gesture of the user, a second free space gesture of the user, a third plurality of free space gestures of the user, a fourth plurality of free space gestures of the user, wherein the first, second, third plurality and fourth plurality of free space gestures of the user are transmitted to a fourth database on the data storage device for storage, further wherein the user uses the executable software to assign the first free space gesture to begin performance of at least one song from the first database, assigns the second free space gesture to end performance of the at least one song from the first database, assigns each free space gesture from the third plurality of free space gestures to perform musical filters on the second database, assigns each free space gesture from the fourth plurality of free space gestures to perform musical song elements on the third database, wherein the user performs the first, second, third plurality and fourth plurality of free space gestures to produce a musical performance.

In embodiments of the subject invention, first, second, third plurality and fourth plurality of free space gestures may include the X and Y locations of the user's hands.

In embodiments of the subject invention, the at least one song from the first database may be a pre-recorded song or portion of a song.

In embodiments of the subject invention, the musical filter from the second database may be adjustments to the pitch, speed, duration, intensity, timbre, or frequency of a musical tone or tones.

In embodiments of the subject invention, the musical filter from the second database may be adjustments to the pitch, rhythm, tempo, timing, speed, duration, intensity, timbre, of the vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

In embodiments of the subject invention, the song element from the third database may be vocals, partial vocals, rhythms, baseline beats, drums, chords, choruses, refrains, verses, chorus, bridges, codas, musical hooks, musical riffs, rhythmic passages, instrumental parts, musical samples, or analogue sounds.

The subject invention discloses a system for body-motion based music control, comprising: a computing device comprising executable software; a data storage device; a first database of musical sounds on the data storage device; a depth camera, wherein the depth camera detects a user, further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention further discloses a system for body-motion based music control, comprising: a computing device comprising executable software; a data storage device comprising a first database, wherein the anatomical size and shape of a user is inputted into the computing device; a depth camera, wherein the depth camera detects a head, left arm, right arm, torso, left leg, and right leg of the user; further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention further discloses a method for body-motion based music control, comprising: inputting the height, weight, sex, and body type of a user into a computing device that comprises a data storage device and executable software; a depth camera, wherein the depth camera detects a user, further wherein the depth camera captures a plurality of free space gestures of the user, wherein the plurality of free space gestures is transmitted to a second database on the data storage device for storage, wherein the executable software assigns each bodily movement from the second database to a musical sound on the first database; wherein the user performs free space gestures from the plurality of free space gestures to produce a musical composition.

The subject invention discloses a computer-implemented system for using body-motion recognition to produce musical compositions, comprising: a computing device comprising executable software; a data storage device; a first database of musical sounds on the data storage device; a motion detection camera, wherein the motion detection camera detects a human being, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

The subject invention discloses a computer-implemented system for using body-motion recognition to produce musical compositions, comprising: a computing device comprising executable software; a data storage device; a first database of musical sounds on the data storage device; a motion detection camera, wherein the anatomical size and shape of a user is inputted into the computing device; a depth camera, wherein the depth camera detects a head, left arm, right arm, torso, left leg, and right leg of the user, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

The subject invention discloses a computer-implemented system for using body-motion recognition to produce musical compositions, comprising: inputting the height, weight, sex, and body type of a user into a computing device comprising executable software; a data storage device; a first database of musical sounds on the data storage device; a motion detection camera, wherein the motion detection camera detects a human being, further wherein the motion detection camera captures a plurality of ordered movements of the human, wherein the plurality of ordered movements is transmitted to a second database on the data storage device for storage, wherein the executable software assigns each ordered movement from the second database to a musical sound on the first database; wherein the user performs movements from the plurality of ordered movements to produce a musical composition.

In other embodiments of the subject invention, the plurality of musical sounds, effects, filters, performances, and/or bodily movements may be pre-installed from the Internet or computer-readable media.

In embodiments of the subject invention, the computing device may be a game console, a laptop, a tablet, a smartphone, or a desktop computer.

In embodiments of the subject invention, the system may perform a combined musical performance with bodily movements or free gestures from at least one additional user, wherein the additional user may be at a separate location.

In embodiments of the subject invention, the system may be incorporated for performance in sync with video game play.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. These together with other objects of the invention, along with the various features of novelty, which characterize the invention, are pointed out with particularity in the claims annexed to and forming a part of this disclosure.

BRIEF DESCRIPTION OF THE DRAWINGS

Advantages of the present invention will be apparent from the following detailed description of exemplary embodiments thereof, which description should be considered in conjunction with the accompanying drawings.

DETAILED DESCRIPTION OF EMBODIMENTS

While several variations of the present invention have been illustrated by way of example in particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

For a conceptual understanding of the invention and its operational advantages, refer to the accompanying drawings and descriptive matter in which there are preferred embodiments of the invention illustrated. Other features and advantages of the present invention will become apparent from the following description of the preferred embodiment(s), taken in conjunction with the accompanying drawings, which by way of example; illustrate the principles of the invention.

Figure 1:
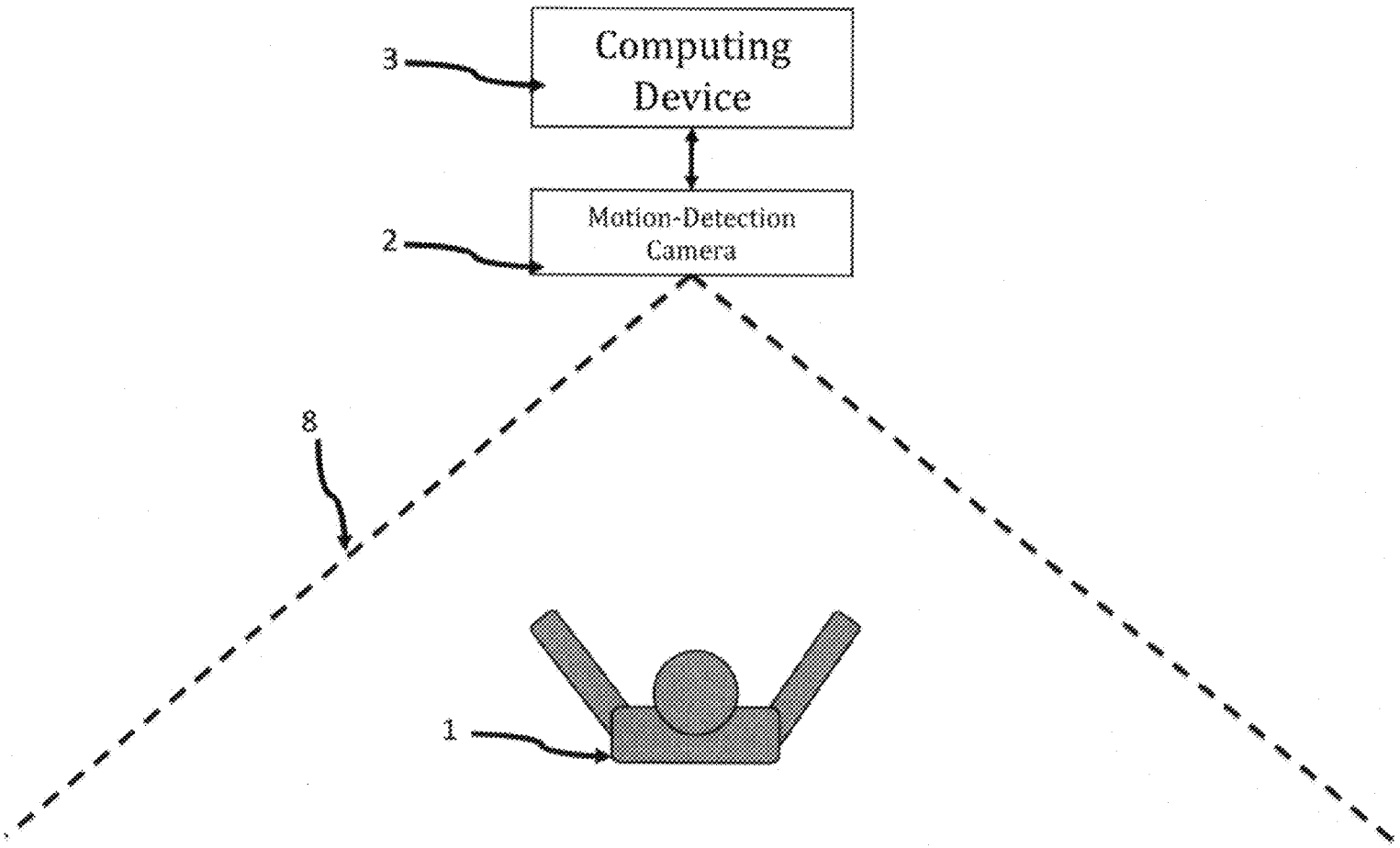
FIG. 1 is a top view of one embodiment of the system capturing a series of bodily movements of a user performing a musical piece.
Figure 2:
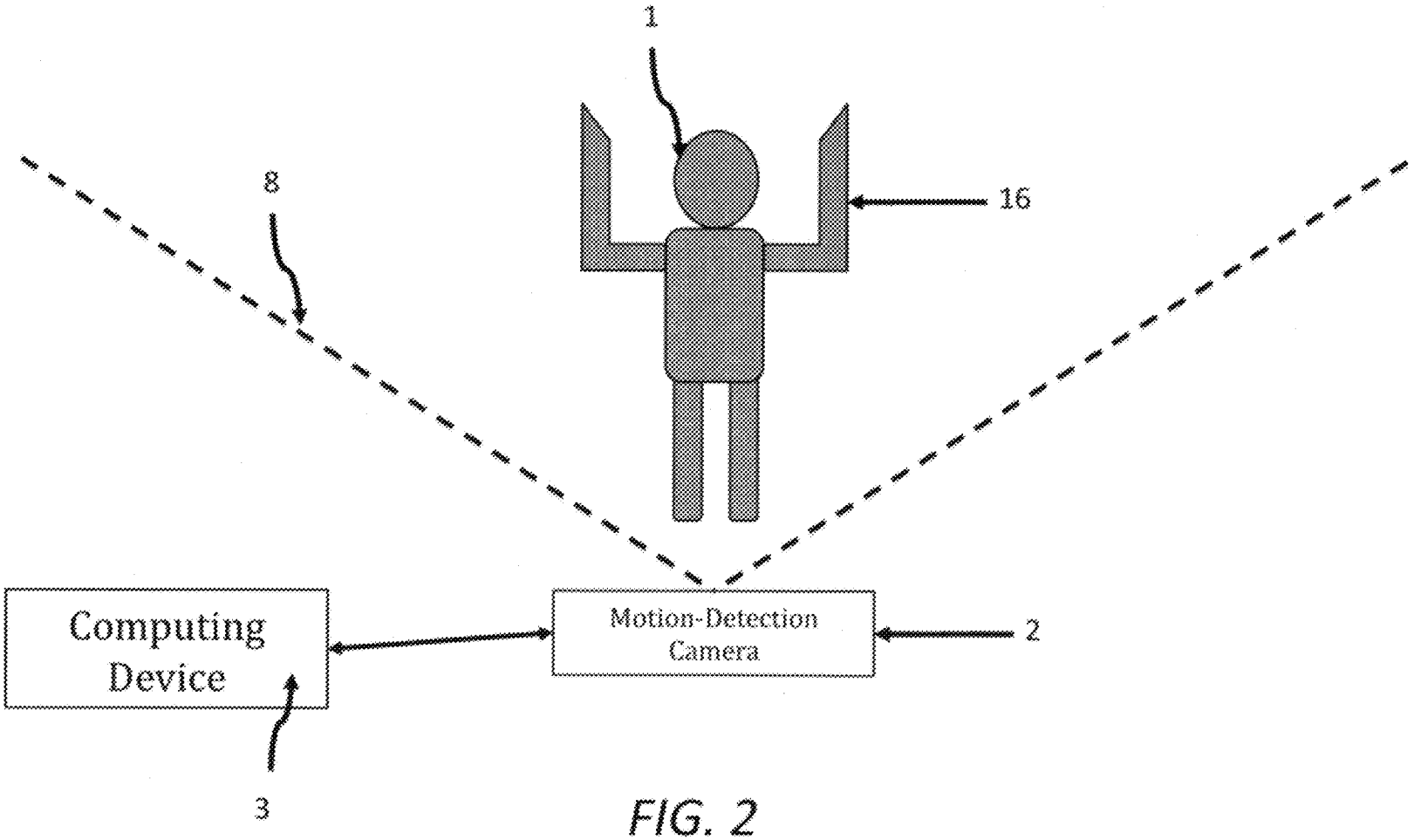
FIG. 2 is a front view of the embodiment of the system capturing a series of bodily movements of a user performing a musical piece.
Figure 3:
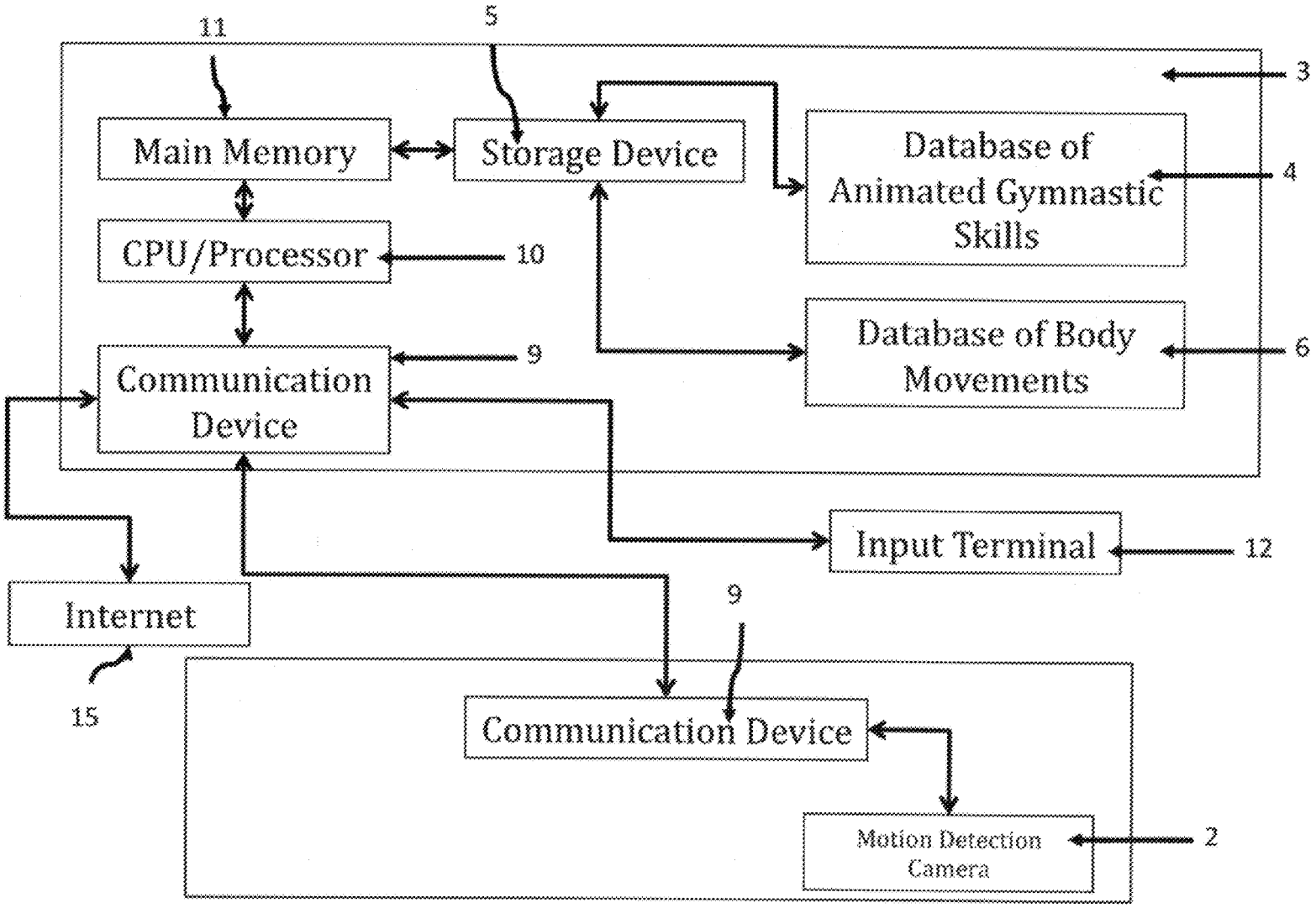
FIG. 3 is a block diagram illustrating a configuration of the system.

As illustrated in FIGS. 1-3, the subject invention discloses a body motion-based music control system. The system allows a user 1 to control the development and shape of musical phrases using only body movement.

The system incorporates a motion-detection camera platform 2, such as the Microsoft XBOX 360 KINECT® motion detection camera and a single computing device 3 capable of running executable software applications, such as a laptop, a tablet, a smartphone, or a desktop computer.

The computing device 3 executes music creation or music modification software, such as Ableton live music software. The computing device 3 further executes plug-in software SYNAPSE that operatively connects the motion detection camera 2 with the computing device 3 and turns recognized body movements points from the motion detection camera into digital musical signals for the Ableton live music software. This system transforms the body into a musical instrument of itself turning movement into sound.

To begin, a user 1 first creates or downloads a digital database 4 of baseline beats, drums, melodies, chords, choruses, phrases, sounds, and samples onto a storage device 5 of the computing device 3. In embodiments of the subject invention, this database 4 of musical sounds may be pre-installed onto the storage device 5 or computer-readable media that may be uploaded to the storage device 5. In another embodiment of the subject invention, the database 4 of musical sounds may be downloaded from the Internet 15.

The user may choose which body movements will trigger a musical sound within the database 4. The system also recognizes the constant X and Y axis of each of twelve body points on the user 1 (two feet, two knees, one Torso, two elbows, two shoulders, two Hands, and the head) which can be set to control other effects in the software. A single point movement may activate a certain musical sound in six different ways (up, down, left, right, forward backwards). A user 1 may also choose to make two or more simultaneous movements to trigger a whole different set of musical sounds.

Once the database 4 of musical sounds have been stored on the computing device 3, a user 1 assigns designated bodily movements to a second digital database 6 onto the storage device 5. The height, weight, sex, and body type of the user 1 are inputted into the computing device 3. The designated bodily movements may include movements to begin and end the musical performance, and movements for each baseline beat, chorus, phrase, sound, or sample contained within the digital database 4.

In one embodiment of the subject invention, the user 1 may perform each bodily movement in front of the motion detection camera 2. The motion detection camera 2 will detect 8 the user's 1 bodily movements and, through the software, capture each movement into the second database 6 of designated bodily movements. The motion detection camera 2 may identify different movements for each part of the body, including the head, each arm, and each leg. Furthermore, the user 1 may assign musical filters and delays to the X and Y Axis locations of each of his or her hands to give control of the musical tone during the performance.

Once the database 4 of musical sounds, and the corresponding second database 6 of assigned designated bodily movements, have been uploaded to the computing device 3, the user may begin the musical performance. The motion detection camera 2 will detect each user bodily movement during the performance and, through the software plug-in, activate or deactivate the appropriate sounds in the music digital library contained within the music software. In embodiments of the subject invention, the motion detection camera 2 will only recognize the first user 1 in front of it during the first five to ten seconds as the body to motion capture. The motion capture camera 2 will not track any other bodies or objects until the camera 2 is reset by the computing device 3. With this system, a user 1 may create musical recordings or mix recordings using only his or her body movements. Furthermore, since a bodily movement has been designated to begin and end the performance, this system may be performed from beginning to end with only one user, without the need for additional helpers.

In a further embodiment of the subject invention, the system may include a projector or a lighting system. Bodily movements may be designated to trigger visuals such as lights on stage or projected images.

In another embodiment of the subject invention, the system allows a user to download an album of music to database 4 and corresponding bodily movements to database 6 in which body movements and music samples have already been prepared for the user 1 to perform. This album would allow the user 1 the ability to perform and recreate each song to his or her own choosing using nothing more then the body and the system.

In a further embodiment of the subject invention, the system may be incorporated into video games that would allow the player to evolve the music's development by controlling the layers of the songs by body movement.

In another embodiment of the subject invention, the system may be used for education simulation such as conducting a virtual orchestra and each body movement could cue an instrument.

In a further embodiment of the subject invention, the system may be used by users suffering from mental or physical disabilities. A patient who is recovering from an injury could use the system to modify music along with his movement during physical therapy to raise volume levels, or trigger the next song on a playlist. People with mental disabilities could also create music by dancing, or moving, allowing for a whole new realm of treatment for children with social and development issues.

In an additional embodiment of the subject invention, the system may be used to enhance physical fitness training, or other health related exercises such as Yoga, tai chi, and meditation. In Yoga or Tai Chi, the user could manipulate the tones and more according to which position they are posing in, along with fluid transitions through the movement. For physical fitness training such as in-place aerobics, a user could choose a song to workout too, and in order to keep the pace of the song, the user must keep pace with the song tempo in order to play the next four measures of music, or more.

Example 1

The user 1 has uploaded the database 4 of musical sounds, and the corresponding second database 6 of assigned designated bodily movements to the computing device 3. The user 1 activates the motion-detection camera platform 2, the computing device 3, the music modification software, and the plug-in software SYNAPSE. The user 1 then loads a selected song into the music modification software.

The user 1 begins the musical performance with his or her body in a "cactus" like shape 16, with both arms up, elbows bent, and the legs shoulder-width apart. The motion detection camera 2 will detect 8 the user's 1 bodily movements and, through the motion-detection camera platform 2, capture each movement into the second database 6 of designated bodily movements.

In this example, the user 1 begins the musical song by raising his or her right hand. The X and Y locations of the user's 1 hands and legs will activate musical effects to alter the song as it plays, such as Delay, LFO Filters, Beat Repeats, and any other effects available in the musical modification software. The user 1 may end the musical song by taking a step backwards.

Example 2

The user 1 has uploaded the database 4 of musical sounds, and the corresponding second database 6 of assigned designated bodily movements to the computing device 3. The user 1 activates the motion-detection camera platform 2, the computing device 3, the music modification software, and the plug-in software SYNAPSE. The user 1 then loads a selected musical pieces into the music modification software.

The user 1 begins the musical performance by raising his or her right hand to start an introduction. With a piano track entering, along with a shaker, the user 1 may hear the song develop. The X and Y locations of the user's 1 arms will activate musical effects for the song as it plays. The user's 1 right hand location determines the amount of delay, and the user's 1 left hand controls the LFO-Filter. Once the introduction is about to end, the user 1 may raise his or her left hand to signal in the first verse. If the user 1 raises his or her right leg, it may trigger another effect called Beat Repeat, which makes the track skip in time with the song. The height of the raised right leg determines the length into which the skip is subdivided. The user 1 may then lift his or her left leg to begin the chorus. The user 1 may raise his or her right hand to signal in the second verse. After finishing up another chorus, the user 1 may lift his or her left leg to begin another chorus. The user 1 may end the musical song by taking a step backwards.

Example 3

The user 1 has uploaded the database 4 of musical sounds, and the corresponding second database 6 of assigned designated bodily movements to the computing device 3. The user 1 activates the motion-detection camera platform 2, the computing device 3, the music modification software, and the plug-in software SYNAPSE. The user 1 then loads a selected musical pieces into the music modification software.

The user 1 begins the musical performance by raising his or her right hand to start a string line for the introduction. The user 1 may bring in a shaker by moving his or her right hand upwards. The user 1 may add bass by raising his or her right knee. Once the introduction is about to end, the user 1 may raise both hands to signal in the first chorus. The user 1 may then start the first verse by moving his or her body to the right.

In the example, either arm's X-Y location may track the volume of that musical sample, such that with the hand up, that volume would increase, and with the hand down, the volume would decrease.

The user 1 may now conclude the performance by putting both hands up at the same time to trigger the outro. Lastly, to end the song the user 1 may put both arms outwards to stop all tracks.

Architecture of the System

FIG. 3 illustrates a block diagram that depicts one embodiment of the computing device 3 architecture. The computing device 3 may include a communication device (such as a bus) 9, a CPU/processor 10, a main memory 11, a storage device 5, a database of musical sounds 4, and a database of body movements 6.

The communication device 9 may permit communication between the computing device 3 and the motion detection camera 2, and the Internet 15. Embodiments of the communication device 9 of the computing device 3 may include any transceiver-like mechanism that enables the computing device 3 to communicate with other devices or systems. The communication may be over a network such as a wired or wireless network. The network communication may be based on protocols such as Ethernet, IP, TCP, UDP, or IEEE 802.11.

Embodiments of the processor unit 10 of the computing device 3 may include processors, microprocessors, multi-core processors, microcontrollers, system-on-chips, field programmable gate arrays (FPGA), application specific integrated circuits (ASIC), application specific instruction-set processors (ASIP), or graphics processing units (GPU). In one embodiment, the processor unit 10 may enable processing logic to interpret and execute instructions.

In a further embodiment, the main memory may store computer retrievable information and software executable instructions. These software executable instructions may be instructions for use by the processor unit. The storage device 5 may computer retrievable information and software executable instructions for use by the processor and may also include a solid state, magnetic, or optical recording medium.

Embodiments of an input terminal 12 of the computing device 3 may include a keyboard, a mouse, a pen, a microphone combined with voice recognition software, a camera, a smartphone, a tablet, a touchpad, or a multi-point touch screen.

In embodiments of the subject invention, the underlying architecture of the system may be implemented using one or more computer programs, each of which may execute under the control of an operating system, such as Windows, OS2, DOS, AIX, UNIX, MAC OS, iOS, ChromeOS, Android, and Windows Phone or CE.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A musical performance system, comprising: a computing device comprising executable software; a data storage device; a first database of musical songs on the data storage device; a second database of musical filters on the data storage device; a third database of musical song elements on the data storage device; a motion detection camera, wherein the motion detection camera detects a user, further wherein the motion detection camera captures a first bodily movement of the user, a second bodily movement of the user, a third plurality of bodily movements of the user, a fourth plurality of bodily movements of the user, wherein the first, second, third plurality and fourth plurality of bodily movements of the user are transmitted to a fourth database on the data storage device for storage, further wherein the user uses the executable software to assign the first bodily movement to begin performance of at least one song from the first database, assigns the second bodily movement to end performance of the at least one song from the first database, assigns each bodily movement from the third plurality of bodily movements to perform musical filters on the second database, assigns each bodily movement from the fourth plurality of bodily movements to perform musical song elements on the third database, wherein the user performs the first, second, third plurality and fourth plurality of bodily movements to output a unique musical performance.

2. The system of claim 1, wherein the one song from the first database is selected from the group consisting of a pre-recorded song and portion of a song.

3. The system of claim 1, wherein the musical filter from the second database is selected from the group consisting of adjustments to the pitch, speed, duration, intensity, timbre, and frequency of a musical tone.

4. The system of claim 1, wherein the musical filter from the second database is selected from the group consisting of adjustments to the pitch, rhythm, tempo, timing, speed, duration, intensity, timbre, of the vocals, partial vocals, rhythms, baseline beats, drums, chords, choruses, refrains, verses, chorus, bridges, codas, musical hooks, musical riffs, rhythmic passages, instrumental parts, musical samples, and analogue sounds.

5. The system of claim 1, wherein the song element from the third database is selected from the group consisting of vocals, partial vocals, rhythms, baseline beats, drums, chords, choruses, refrains, verses, chorus, bridges, codas, musical hooks, musical riffs, rhythmic passages, instrumental parts, musical samples, and analogue sounds.

6. The system of claim 1, wherein, the computing device is selected from the group consisting of a game console, a laptop, a tablet, a smartphone, and a desktop computer.

7. The system of claim 1, wherein the system further comprises a second user at the same location as the user, wherein the second user performs the first, second, third plurality and fourth plurality of bodily movements to output a combined unique musical performance.

8. The system of claim 1, wherein the system further comprises a second user at the different location as the user, wherein the second user performs the first, second, third plurality and fourth plurality of bodily movements to output a combined unique musical performance.

9. The system of claim 1, wherein the user performs the first, second, third plurality and fourth plurality of bodily movements to output a unique musical performance in sync with video game play.

* * * * *